US007417653B2

(12) United States Patent
Sung et al.

(10) Patent No.: US 7,417,653 B2
(45) Date of Patent: Aug. 26, 2008

(54) ELECTROSTATIC LATENT IMAGE FORMING MEDIUM USING OPTICAL SHUTTER ARRAY AND IMAGE FORMING APPARATUS HAVING THE SAME

(75) Inventors: Gee-young Sung, Daegu-si (KR); Seong-jin Kim, Seongnam-si (KR); Seung-joo Shin, Seoul (KR); Kye-si Kwon, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 325 days.

(21) Appl. No.: 11/251,805

(22) Filed: Oct. 18, 2005

(65) Prior Publication Data

US 2006/0082634 A1 Apr. 20, 2006

(30) Foreign Application Priority Data

Oct. 18, 2004 (KR) ..... 10-2004-0083197

(51) Int. Cl.
*G03G 15/043* (2006.01)

(52) U.S. Cl. ..... 347/136

(58) Field of Classification Search ..... 347/111, 347/112, 130, 233, 136
See application file for complete search history.

(56) References Cited

U.S. PATENT DOCUMENTS 4,803,514 A * 2/1989 Hiratsuka et al. ..... 399/178
4,947,195 A 8/1990 Flynn et al. ..... 346/155
4,961,094 A * 10/1990 Yamaoki et al. ..... 399/232
5,541,722 A * 7/1996 Ikeda et al. ..... 399/178
5,729,809 A * 3/1998 Haneda et al. ..... 399/308

FOREIGN PATENT DOCUMENTS

EP 0 749 050 12/1996
JP 60-055364 3/1985

* cited by examiner

*Primary Examiner*—Huan H Tran
(74) *Attorney, Agent, or Firm*—Lee & Morse, P.C.

(57) ABSTRACT

An image forming apparatus includes an electrostatic latent image forming medium, a charge unit charging the surface of the electrostatic latent image forming medium with a predetermined potential, a toner supply unit (TSU) supplying toner to an electrostatic latent image formed on the surface of the electrostatic latent image forming medium to develop the electrostatic latent image into a toner image, and a transfer unit transferring the toner image to a print medium, the electrostatic latent image forming medium including a transparent frame member, a light source inside the frame member, an optical shutter array including a plurality of optical shutters, and a photoconductive layer on which the electrostatic latent image is formed using light transmitted through the optical shutter array. A diffuser may surround the light source to diffuse light to maintain the intensity of light reaching the optical shutters at a uniform level.

23 Claims, 5 Drawing Sheets

ELECTROSTATIC LATENT IMAGE FORMING MEDIUM USING OPTICAL SHUTTER ARRAY AND IMAGE FORMING APPARATUS HAVING THE SAME

BACKGROUND OF THE INVENTION

1. Field of the Invention

The present invention relates to an image forming apparatus. More particularly, the present invention relates to an electrostatic latent image forming medium for forming an electrostatic latent image using an optical shutter array and an image forming apparatus having such electrostatic latent image forming medium.

2. Description of the Related Art

In general, electrophotographic image forming apparatuses, such as copiers, laser printers, and facsimile machines, print an image by forming an electrostatic latent image on a photosensitive medium, such as a photoconductive drum or a photoreceptor belt, using a laser scanning unit (LSU), developing the electrostatic latent image using a developing agent having a predetermined color, and transferring the developed image onto a sheet of paper.

FIG. 1 is a perspective, schematic view of a conventional electrophotographic image forming apparatus including an LSU.

Referring to FIG. 1, the conventional image forming apparatus includes a photoconductive drum 20 on a surface of which an electrostatic latent image is formed, an LSU 10 scanning a laser beam to form the electrostatic latent image on the surface of the photoconductive drum 20, and a toner supply roller 30 supplying toner to the electrostatic latent image formed on the surface of the photoconductive drum 20.

The LSU 10 includes a laser diode (LD) 11 emitting a laser beam, a polygon mirror 12 scanning the laser beam emitted from the LD 11, a focusing lens 13 focusing a laser beam reflected by the polygon mirror 12, and a reflective mirror 14 reflecting a laser beam passing through the focusing lens 13 to form an electrostatic latent image on the surface of the photoconductive drum 20.

When the LSU 10 scans a laser beam onto the surface of the photoconductive drum 20 charged with a predetermined potential, the electric charges in a portion of the surface of the photoconductive drum 20 onto which the laser beam is scanned disappear, i.e., the electric charges become neutralized. Accordingly, an electrostatic latent image with a potential different from potentials of other portions of the surface of the photoconductive drum 20 is formed in the portion onto which the laser beam is scanned. Toner supplied by the toner supply roller 30 is selectively adhered to the electrostatic latent image by an electrostatic force. Thus, the electrostatic latent image is developed into a desired image. The image developed on the photoconductive drum 20 is transferred to a sheet of print paper P and then fixed on the sheet of print paper P by a fixing unit (not shown).

The LSU 10 has a complicated structure, and consequently the size of the conventional image forming apparatus is large, and the manufacturing costs thereof are high. Accordingly, there is a limitation in realizing a compact and inexpensive image forming apparatus using the LSU 10.

Also, since the LSU 10 scans a laser beam and forms an electrostatic latent image in a line-by-line manner while the polygon mirror 12 is rotated by a motor (not shown), it is difficult to increase print speed by reducing the time spent on scanning the laser beam. Since the rotation speed of the polygon mirror 12 is limited to a maximum of 55,000 rpm due to vibrations and noises caused by the rotation of the polygon mirror 12 of the LSU 10, maximum print speed using an LSU is limited by this limitation in rotational speed of the polygon mirror 12.

SUMMARY OF THE INVENTION

The present invention is therefore directed to an electrostatic latent image forming medium and apparatus which substantially overcome one or more of the problems due to limitations and disadvantages of the related art.

It is a feature of an embodiment of the present invention to provide an electrostatic latent image forming medium that forms an electrostatic latent image using an optical shutter array.

It is another feature of an embodiment of the present invention to provide an image forming apparatus including the electrostatic latent image forming medium, which has a compact structure.

It is yet another feature of an embodiment of the present invention to provide an image forming apparatus including the electrostatic latent image forming medium, which has a fast printing speed.

At least one of the above and other features and advantages of the present invention may be realized by providing an electrostatic latent image forming medium on a surface of which an electrostatic latent image is formed and which is used in an image forming apparatus, the electrostatic latent image forming medium including a transparent cylindrical frame member, at least one light source disposed inside the frame member, an optical shutter array including a plurality of optical shutters that selectively transmit light emitted from the light source, and a photoconductive layer on which an electrostatic latent image is formed using light transmitted through the optical shutter array.

The optical shutter array and the photoconductive layer may be sequentially stacked on an outer circumferential surface of the transparent cylindrical frame member. The electrostatic latent image forming medium may further include a transparent electrode formed on an outer circumferential surface or an inner circumferential surface of the optical shutter array for driving the plurality of optical shutters. The transparent electrode may be made of Indium Tin Oxide (ITO).

The frame member may be made of glass or plastic through which light may pass.

The electrostatic latent image forming medium may further include a diffuser that surrounds the light source and diffuses light emitted from the light source to maintain the intensity of light reaching the respective optical shutters at a uniform level.

The light source may be a line light source. The line light source may be a cold cathode fluorescent lamp.

The light source may include a plurality of line light sources, and the plurality of line light sources may be arranged in a circumferential direction or radial pattern at predetermined intervals. A plurality of diffusers may respectively surround the plurality of line light sources, i.e., each of the plurality of line light sources may be surrounded by one of a corresponding plurality of diffusers. Alternatively, one diffuser may surround all of the plurality of line light sources.

The electrostatic latent image forming medium may further include a micro-lens array including a plurality of focusing lenses that focus light emitted from the light source to the respective optical shutters. The micro-lens array may be integrally formed with the frame member.

The optical shutter array may include a liquid crystal display, an electrophoretic device, or an electrochromic device. The optical shutter array may be made to be sufficiently flexible such that it may be wound or adhered around an outer circumferential surface of the frame member.

At least one of the above and other features and advantages may be realized by providing an image forming apparatus, including an electrostatic latent image forming medium on a surface of which an electrostatic latent image is formed, a charge unit charging the surface of the electrostatic latent image forming medium with a predetermined potential, a toner supply unit (TSU) supplying toner to the electrostatic latent image formed on the surface of the electrostatic latent image forming medium to develop the electrostatic latent image into a toner image, and a transfer unit transferring the toner image to a print medium, wherein the electrostatic latent image forming medium includes a transparent cylindrical frame member, at least one light source disposed inside the frame member, an optical shutter array including a plurality of optical shutters that selectively transmit light emitted from the light source, and a photoconductive layer on which the electrostatic latent image is formed using light transmitted through the optical shutter array.

The toner supply unit (TSU) may be a toner supply roller that rotates in contact with the toner stored in a toner container and adheres the toner to the electrostatic latent image formed on the surface of the electrostatic latent image forming medium.

The transfer unit may be a transfer roller that is rotatably disposed in parallel to the electrostatic latent image forming medium so that the print medium may pass between the transfer unit and the electrostatic latent image forming medium.

The image forming apparatus may further include a potential eliminating unit eliminating the potential on the surface of the electrostatic latent image forming medium.

A plurality of electrostatic latent images may be formed on the photoconductive layer of the electrostatic latent image forming medium to print a color image, and a plurality of toner supply units (TSUs) and charge units may be arranged to respectively correspond to the plurality of electrostatic latent images.

BRIEF DESCRIPTION OF THE DRAWINGS

The above and other aspects, features and advantages of the present invention will become more apparent to those of ordinary skill in the art by describing in detail exemplary embodiments thereof with reference to the attached drawings in which.

DETAILED DESCRIPTION OF THE INVENTION

Figure 1:
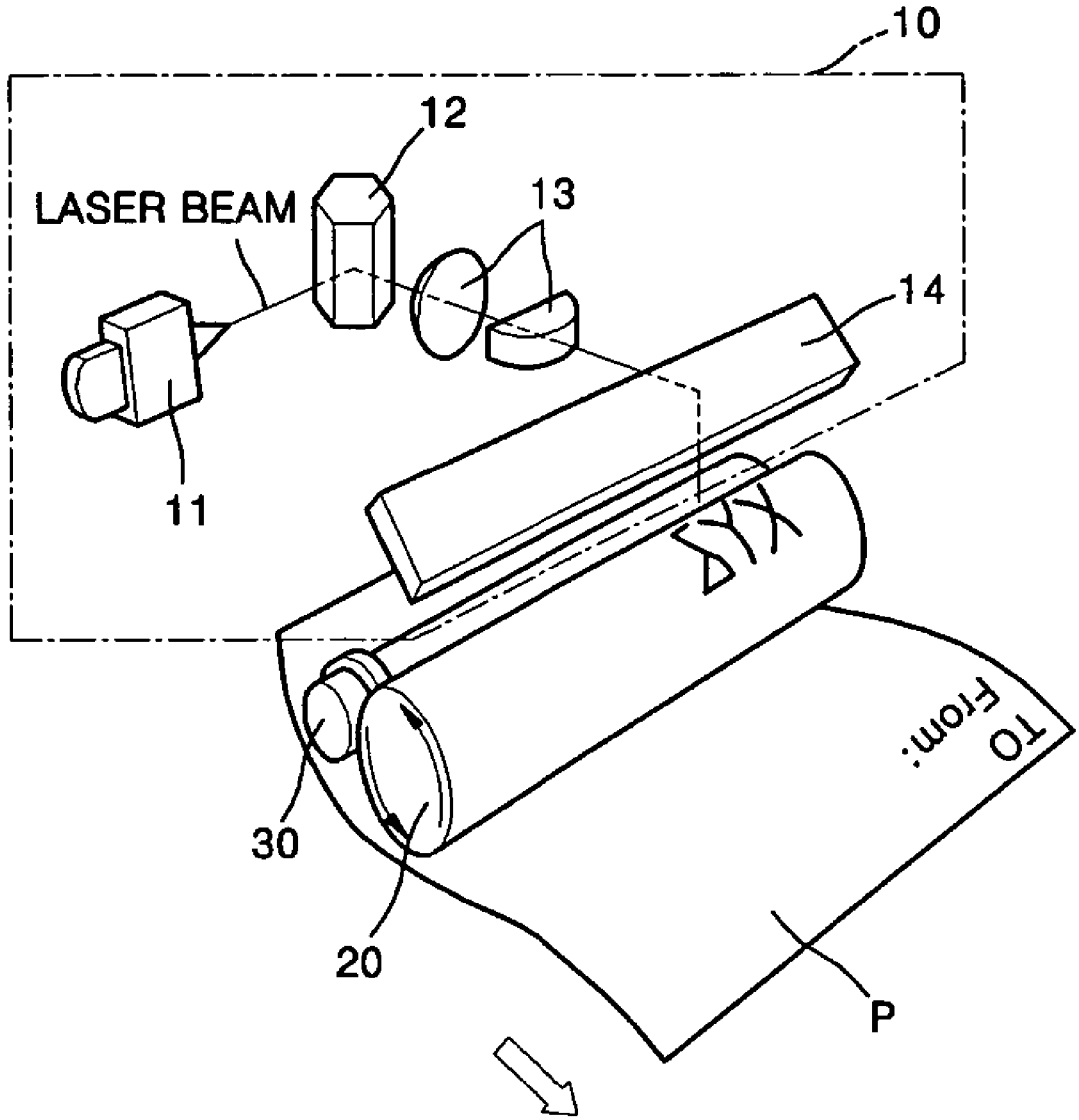
FIG. 1 (PRIOR ART)
FIG. 1 illustrates a perspective, schematic view of a conventional image forming apparatus, including a conventional laser scanning unit (LSU)

This application claims the benefit of Korean Patent Application No. 10-2004-0083197, filed on Oct. 18, 2004, in the Korean Intellectual Property Office, the disclosure of which is incorporated herein in its entirety by reference.

The present invention will now be described more fully with reference to the accompanying drawings, in which preferred embodiments of the invention are shown. The same elements are given the same reference numerals throughout the drawings.

Figure 2:
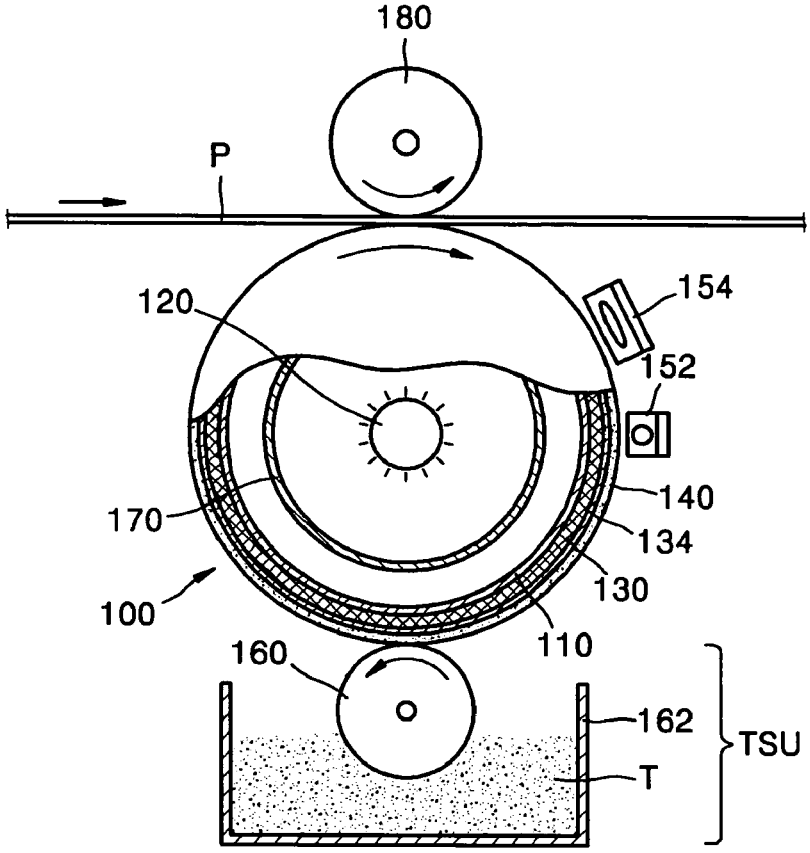
FIG. 2 illustrates a lateral, elevational, sectional view of an image forming apparatus, including a photoconductive drum according to an embodiment of the present invention.
Figure 3:
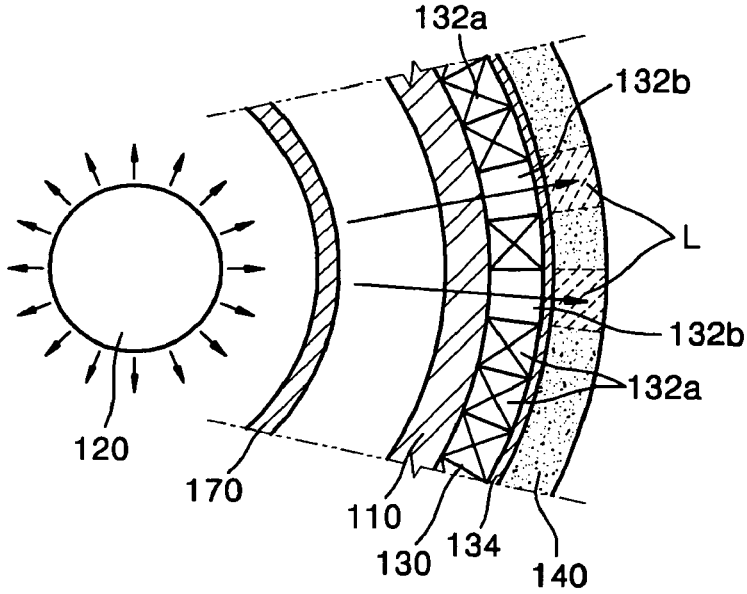
FIG. 3 illustrates an enlarged, partial sectional view of the photoconductive drum of FIG. 2, illustrating a state where an electrostatic latent image is formed on a surface of the photoconductive drum.

Referring to FIGS. 2 and 3, the image forming apparatus may include an electrostatic latent image forming medium, a charge unit 152, a toner supply unit (TSU), and a transfer unit. The electrostatic latent image forming medium may be configured such that an electrostatic latent image L corresponding to an image to be printed is formed on a surface of the electrostatic latent image forming medium. A photoconductive drum 100 may be used as the electrostatic latent image forming medium. The photoconductive drum 100 may include a transparent cylindrical frame member 110, a light source 120 disposed inside the frame member 110, an optical shutter array 130 including a plurality of optical shutters 132*a* and 132*b* that selectively transmit light emitted from the light source 120, and a photoconductive layer 140 on which the electrostatic latent image L is formed using light transmitted through the optical shutter array 130. The photoconductive drum 100 constructed as above will be explained later in detail.

The charge unit 152 may charge the surface of the photoconductive drum 100, i.e., the photoconductive layer 140, with a predetermined potential. The charge unit 152 may be in the form of a charge roller or a corona wire, but is not limited to these examples.

The toner supply unit (TSU) supplies toner T to the electrostatic latent image L formed on the surface of the photoconductive drum 100 to develop the electrostatic latent image L into a toner image. A variety of devices well known to those of ordinary skill in the art may be used as the toner supply unit (TSU). For example, a toner supply roller 160 rotating in contact with the toner T stored in a toner container 162 may be used as the toner supply unit (TSU) illustrated in FIG. 2. The toner supply roller 160 rotates in synchronization with the photoconductive drum 100 to adhere the toner T stored in the toner container 162 to the electrostatic latent image L formed on the surface of the photoconductive drum 100. A predetermined potential is generally applied to the toner supply roller 160. Accordingly, the toner T adhered to a surface of the toner supply roller 160 is transferred and is adhered to the electrostatic latent image L formed on the photoconductive drum 100 due to a difference between a potential of the surface of the toner supply roller 160 and a potential of the electrostatic latent image L.

The transfer unit transfers the toner image developed on the surface of the photoconductive drum 100 to a print medium, for example, a sheet of paper P. The transfer unit may be in the form of a transfer roller 180 as shown in FIG. 2. The transfer roller 180 is rotatably installed in parallel to the photoconductive drum 100. The sheet of paper P passes between the transfer roller 180 and the photoconductive drum 100, and in this process, the toner image developed on the surface of the photoconductive drum 100 is transferred to the sheet of paper P.

In the meantime, the transfer unit may include an intermediate transfer belt (not shown), whereby the toner image developed on the surface of the photoconductive drum 100 is first transferred to the intermediate transfer belt, after which the toner image is again transferred from the intermediate transfer belt to the sheet of paper P by the transfer roller 180.

The image forming apparatus according to the present embodiment may further include a potential eliminating unit 154 to eliminate the potential remaining on the surface of the photoconductive drum 100 after the toner image is completely transferred from the surface of the photoconductive drum 100 to the sheet of paper P.

The configuration of the electrostatic latent image forming medium, i.e., the photoconductive drum 100, will now be explained in detail. The photoconductive drum 100 may have a substantially cylindrical shape due to the cylindrical frame member 110. The frame member 110 may be made of transparent material, such as glass, so that light emitted from the light source 120 installed inside the frame member 110 may be transmitted therethrough. Alternatively, the frame member 110 may be made of plastic that exhibits high light transmission.

The light source 120 installed inside the frame member 110 may be a one line light source that extends in a longitudinal direction of the frame member 110. The line light source 120 may be a cold cathode fluorescent lamp (CCFL).

A diffuser 170 may be disposed inside the frame member 110 to surround the light source 120. The diffuser 170 diffuses light emitted from the light source 120 to maintain the intensity of light reaching out to the respective optical shutters 132*a* and 132*b* of the optical shutter array 130 at a uniform level. The diffuser 170 may be a holographic diffuser that exhibits low light loss, or a general diffuser made of material that exhibts low light absorption property.

According to the image forming apparatus of the present embodiment, the general lamp and the diffuser 170 which are relatively inexpensive may be used as the light source 120 to apply uniform light to the respective optical shutters 132*a* and 132*b*.

The optical shutter array 130 and the photoconductive layer 140 may be sequentially stacked on an outer circumferential surface of the frame member 110, such that the photoconductive layer 140 is an outermost surface of the photoconductive drum 100. A transparent electrode 134 for driving the optical shutters 132*a* and 132*b* may be formed on an outer circumferential surface of the optical shutter array 130. The transparent electrode 134 may be made of transparent material, for example, Indium Tin Oxide (ITO), through which light may transmit.

Alternatively, the transparent electrode 134 may be formed on an inner circumferential surface of the optical shutter array 130.

The optical shutter array 130 may include the plurality of optical shutters 132*a* and 132*b* that selectively transmit light emitted from the light source 120. The optical shutter array 130 may be formed using an optical shutter such as a liquid crystal display (LCD), an electrophoretic device, or an electrocromic device.

The optical shutter array 130, as shown in FIGS. 2 and 3, is disposed on the outer circumferential surface of the frame member 110. Accordingly, the optical shutter array 130 may be sufficiently flexible such that it may be wound around an outer circumference of the frame member 110. Alternatively, the optical shutter array 130 may be disposed on the inner circumferential surface of the frame member 110. The number of the plurality of optical shutters 132*a* and 132*b* of the optical shutter array 130 may be determined in accordance with a desired resolution of the image forming apparatus. That is, the optical shutters 132 and 132*b* are formed to respectively correspond to pixels of an image.

The plurality of optical shutters 132*a* and 132*b* selectively transmit light emitted from the light source 120. For example, if the plurality of optical shutters 132*a* and 132*b* are selectively driven such that only the optical shutters 132*b* corresponding to pixels of an image to be printed are opened, light may be transmitted through the optical shutters 132*b* but cannot be transmitted through the closed optical shutters 132*a*. Accordingly, an electrostatic latent image corresponding to the pixels of the image to be printed may be formed on portions of the photoconductive layer 140 of the photoconductive drum 100 onto which the light is irradiated by way of selective opening of the optical shutters 132*a* and 132*b*.

As described above, without using a conventional laser scanning unit (LSU) having a complicated structure, the image forming apparatus of the present invention may form an electrostatic latent image L on the circumferential surface of the photoconductive drum 100 using the optical shutter array 130 disposed inside the photoconductive drum 100. Accordingly, a more compact image forming apparatus may be realized at lower manufacturing costs.

A method of forming the electrostatic latent image L on the surface of the photoconductive drum 100 constructed as above will now be explained.

In an embodiment of the present invention, before the electrostatic latent image L is formed on the circumferential surface of the photoconductive drum 110, i.e., on the photoconductive layer 140, the surface of the photoconductive drum 100 is charged with a predetermined potential using the charge unit 152. The light source 120 is turned on, and the optical shutters 132*b* corresponding to an image to be printed may be selectively driven among the plurality of optical shutters 132*a* and 132*b* of the optical shutter array 130. Then, light emitted from the light source 120 may be transmitted through only the opened optical shutters 132*b* to reach the photoconductive layer 140, such that the electrostatic latent image L with a potential different from potentials of portions surrounding the electrostatic latent image L is formed on a portion of the photoconductive layer 140 onto which the light is emitted.

The toner T is selectively adhered to the electrostatic latent image L due to the difference between the potential of the electrostatic latent image L and the potentials of the portions surrounding the electrostatic latent image L, so as to form a toner image. For example, charged toner particles T will adhere to electrostatic latent image L on the circumferential surface of the photoconductive layer 140 of the photoconductive drum 110, where the predetermined potential formed by the charge unit 152 has been erased or neutralized by irradiation with light from the light source 120 as selectively allowed and not allowed to pass through optical shutters 132*a* and 132*b*.

According to the present embodiment, an entire electrostatic latent image may be formed at once, electrically simultaneously, instead of in a line-by-line manner. Therefore, since the electrostatic latent images L corresponding to the image to be printed may be formed at once on a page-by-page basis, instead of on a line-by line basis, the image forming apparatus of the present embodiment exhibits a very high printing speed and is not in any way limited in the manner that conventional apparatus employing LSUs are limited.

Other embodiments of the photoconductive drum will now be explained.

Figure 4:
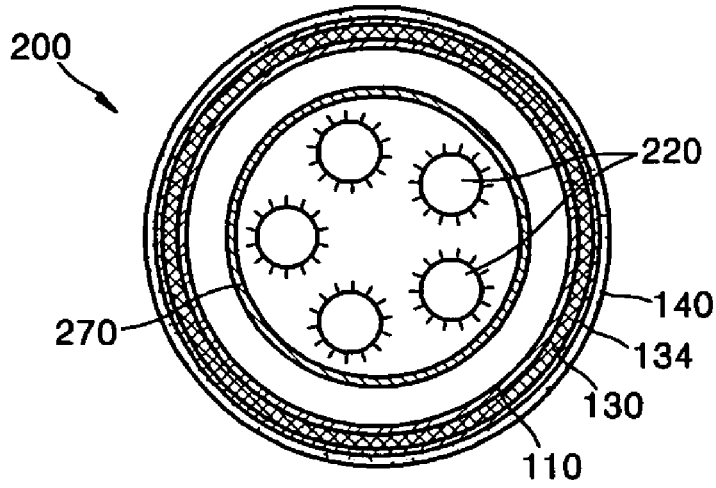
FIG. 4 illustrates a sectional view of a photoconductive drum including a plurality of light sources and one diffuser according to another embodiment of the present invention.
Figure 5:
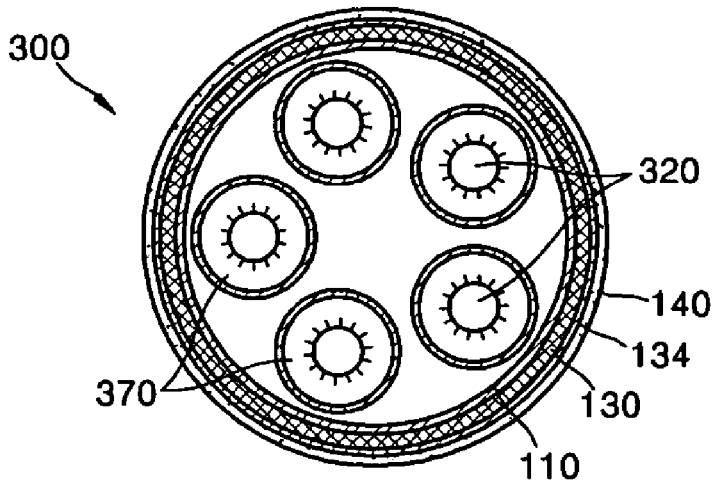
FIG. 5 illustrates a sectional view of a photoconductive drum including a plurality of light sources and a plurality of diffusers according to still another embodiment of the present invention.

FIG. 4 illustrates a sectional view of a photoconductive drum 200 including a plurality of light sources 220 and a diffuser 270 according to another embodiment of the present invention. FIG. 5 illustrates a sectional view of a photoconductive drum 300 including a plurality of light sources 320 and diffusers 370 according to still another embodiment of the present invention.

Referring to FIGS. 4 and 5, in drums 200 and 300, respectively, acting as electrostatic latent image forming media, a plurality of line light sources 220 and 320, respectively, may be arranged inside the frame member 110. The plurality of line light sources 220 and 320 may be arranged in a circumferential direction or radial pattern at predetermined intervals. The plurality of line light sources 220 and 320 may increase the intensity of light.

To improve the uniformity of light, as shown in FIG. 4, a diffuser 270 may surround all the plurality of line light sources 220. Alternatively, as shown in FIG. 5, one diffuser 370 of a corresponding plurality of diffusers may respectively surround each of the plurality of line light sources 320.

Other elements of the photoconductive drums 200 and 300 shown in FIGS. 4 and 5, respectively, including the frame member 100, the optical shutter array 130, the transparent electrode 134, and the photoconductive layer 140 are the same as those of the photoconductive drum shown in FIG. 2.

Figure 6:
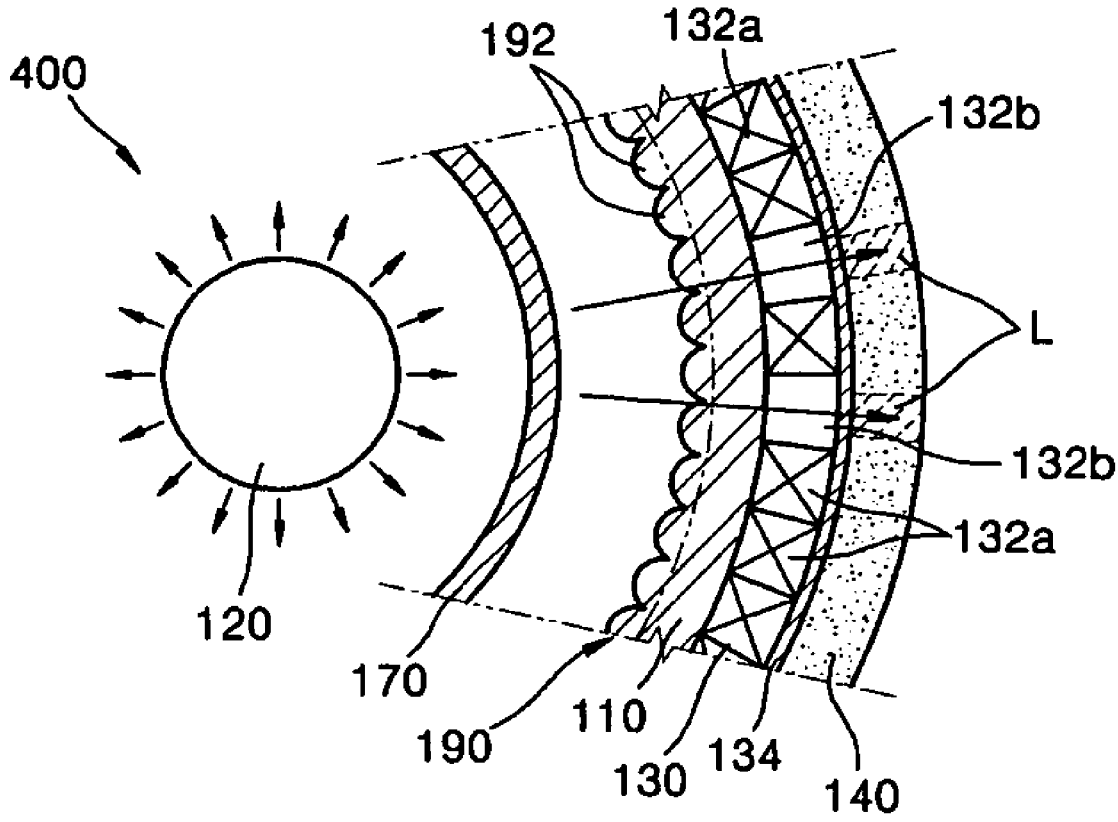
FIG. 6 illustrates a partial sectional view of a photoconductive drum including a micro-lens array according to yet another embodiment of the present invention.

FIG. 6 illstrates a partial sectional view of a photoconductive drum including a micro-lens array according to yet another embodiment of the present invention. The micro-lens array 190 may be disposed inside a photoconductive drum 400. The micro-lens array 190 may include a plurality of focusing lenses 192 that focus light emitted from the light source 120 to the respective optical shutters 132*a* and 132*b*. The plurality of focusing lenses 192 may be arranged to respectively correspond to the plurality of optical shutters 132*a* and 132*b*.

Due to the micro-lens array 190, a size of a spot of light formed on the photoconductive layer 140 may be reduced, and thus an electrostatic latent image L having a higher resolution may be formed.

The micro-lens array 190 may be integrally formed with the frame member 110 made of glass. Accordingly, since the micro-lens array 190 may be easily manufactured and treated, the configuration of the photoconductive drum 400 becomes simpler, and manufacturing costs may be substantially decreased. If the frame member 110 is made of plastic having a high light transmission, the micro-lens array 190 may also be made of plastic.

Figure 7:
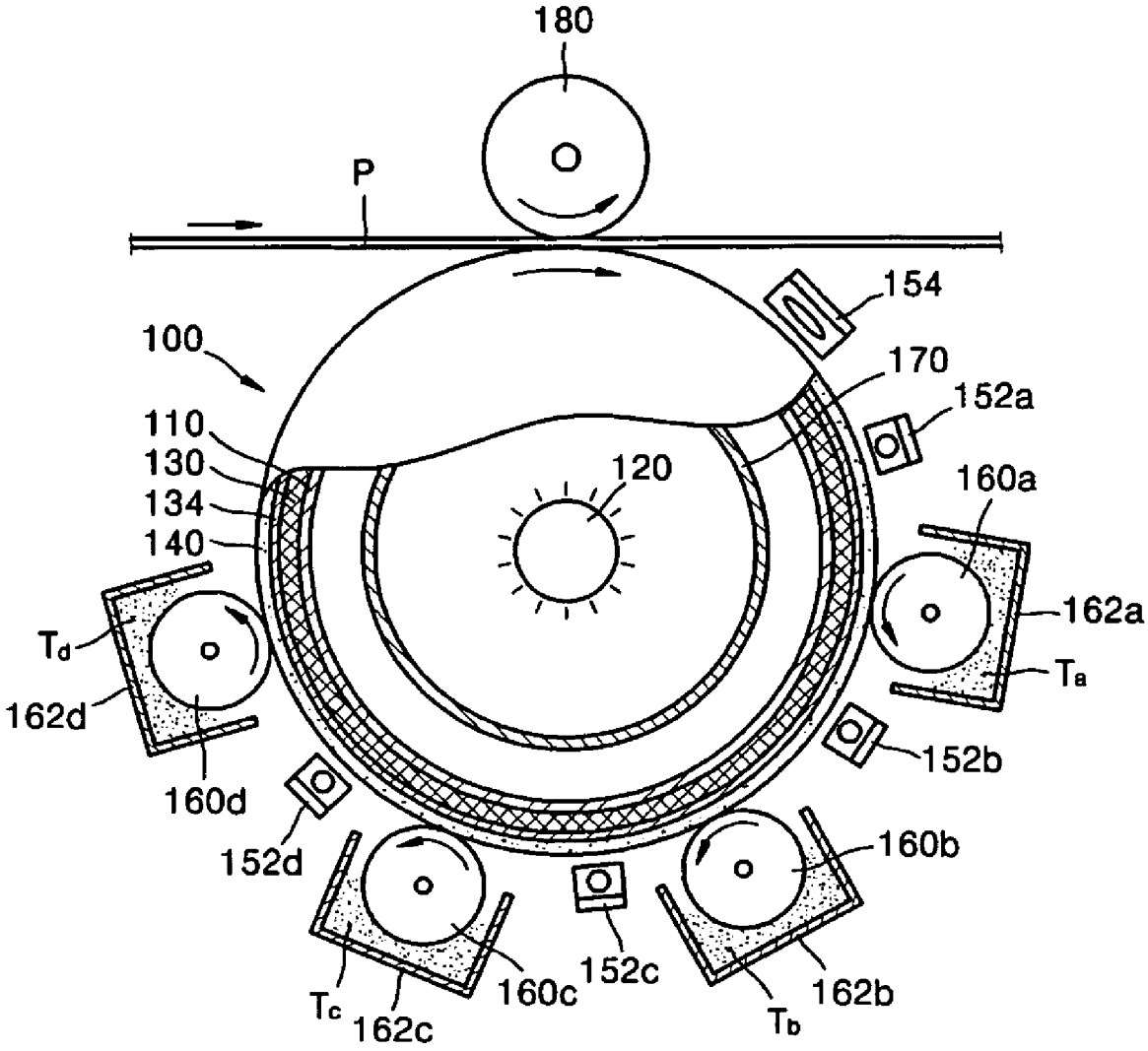
FIG. 7 illustrates a sectional view of a single pass electrophotographic image forming apparatus including a photoconductive drum according to an embodiment of the present invention.

FIG. 7 illustrates a sectional view of a single pass electrophotographic image forming apparatus including a photoconductive drum according to an embodiment of the present invention.

Referring to FIG. 7, an image forming apparatus for printing a color image, for example, a single pass electrophotograhic image forming apparatus, may easily print a color image using the aforesaid photoconductive drum 100. The surface of the photoconductive drum 100, i.e., the photoconductive layer 140, may be divided into four sections, and electrostatic latent images corresponding to four colors may be formed in the four sections in order to print a color image. Four charge units 152*a*, 152*b*, 152*c*, and 152*d* and four toner supply units (TSUs) may be arranged around the photoconductive drum 100 to respectively correspond to the four electrostatic latent images. The toner supply units (TSUs) may include four toner containers 162*a*, 162*b*, 162*c*, and 162*d* in which toners Ta, Tb, Tc, and Td having four colors may be contained, and four toner supply rollers 160*a*, 160*b*, 160*c*, and 160*d* may be installed in the four toner containers 162*a*, 162*b*, 162*c*, and 162*d*.

As described above, since the image forming apparatus forms an electrostatic latent image on the surface of the photoconductive drum using an optical shutter array disposed inside the electrostatic latent image forming medium, i.e., the photoconductive drum, the image forming apparatus may be made to have a simpler configuration than the conventional image forming apparatus that uses the complicated LSU to form an electrostatic latent image. Moreover, with use of the diffuser and the general lamp as the light source, light having uniform intensity may be consistently applied to the plurality of optical shutters. Accordingly, a compact image forming apparatus may be realized with low manufacturing costs.

Since the entirety of an electrostatic latent image may be formed at once or instantaneously on a per page to be printed basis using the instant inventive electrostatic latent image forming medium employing an optical shutter array, the time required for forming the electrostatic latent image may be signifcantly reduced, and print speeds much higher than that of conventional machines that form an electrostatic latent image on a per line basis may be achieved.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An electrostatic latent image forming medium of an image forming apparatus, the electrostatic latent image forming medium comprising:

a transparent frame member;

at least one light source disposed inside the transparent frame member;

an optical shutter array on an outer surface of the transparent frame member and including a plurality of optical shutters that selectively transmit light emitted from the at least one light source; and a photoconductive layer on the optical shutter array, wherein an electrostatic latent image is formed on the photoconductive layer using light transmitted through the optical shutter array.

2. The electrostatic latent image forming medium as claimed in claim 1, wherein the optical shutter array and the photoconductive layer are sequentially stacked on the outer surface of the transparent frame member, the electrostatic latent image forming medium further comprising a transparent electrode formed on an outer surface or an inner surface of the optical shutter array and adapted to drive the plurality of optical shutters.

3. The electrostatic latent image forming medium as claimed in claim 1, further comprising a diffuser surrounding the light source and diffusing light emitted from the light source to maintain the intensity of light reaching the plurality of optical shutters at a uniform level.

4. The electrostatic latent image forming medium as claimed in claim 3, wherein the light source is a line light source.

5. The electrostatic latent image forming medium as claimed in claim 3, wherein the light source includes a plurality of light sources.

6. The electrostatic latent image forming medium as claimed in claim 5, wherein the plurality of light sources is arranged in a radial pattern at predetermined intervals.

7. The electrostatic latent image forming medium as claimed in claim 5, wherein each of the plurality of light sources is surrounded by one of a corresponding plurality of diffusers.

8. The electrostatic latent image forming medium as claimed in claim 5, wherein the diffuser surrounds all of the plurality of light sources.

9. The electrostatic latent image forming medium as claimed in claim 1, further comprising a micro-lens array including a plurality of focusing lenses that focus light emitted from the light source to the respective optical shutters.

10. The electrostatic latent image forming medium as claimed in claim 9, wherein the micro-lens array is integrally formed with the transparent frame member.

11. The electrostatic latent image forming medium as claimed in claim 1, wherein the optical shutter array is flexible such that it can be wound around an outer circumferential surface of the transparent frame member.

12. An image forming apparatus, comprising:

an electrostatic latent image forming medium on a surface of which an electrostatic latent image is formed;

a charge unit charging the surface of the electrostatic latent image forming medium with a predetermined potential;

a toner supply unit (TSU) supplying toner to the electrostatic latent image formed on the surface of the electrostatic latent image forming medium to develop the electrostatic latent image into a toner image; and a transfer unit transferring the toner image to a print medium, wherein the electrostatic latent image forming medium includes:

a transparent frame member;

at least one light source disposed inside the transparent frame member;

an optical shutter array on an outer surface of the transparent frame member and including a plurality of optical shutters that selectively transmit light emitted from the at least one light source; and a photoconductive layer on the optical shutter array, wherein an electrostatic latent image is formed on the photoconductive layer using light transmitted through the optical shutter array.

13. The image forming apparatus as claimed in claim 12, wherein the optical shutter array and the photoconductive layer are sequentially stacked on the outer surface of the transparent frame member, the electrostatic latent image forming medium further comprising a transparent electrode formed on an outer surface or an inner surface of the optical shutter array and adapted to drive the plurality of optical shutters.

14. The image forming apparatus as claimed in claim 12, wherein the electrostatic latent image forming medium further comprises a diffuser surrounding the light source and diffusing light emitted from the light source to maintain the intensity of light reaching the plurality of optical shutters at a uniform level.

15. The image forming apparatus as claimed in claim 14, wherein the light source is a line light source.

16. The image forming apparatus as claimed in claim 14, wherein the light source includes a plurality of light sources.

17. The image forming apparatus as claimed in claim 16, wherein the plurality of light sources is arranged in a radial pattern at predetermined intervals.

18. The image forming apparatus as claimed in claim 16, wherein each of the plurality of light sources is surrounded by one of a corresponding plurality of diffusers.

19. The image forming apparatus as claimed in claim 16, wherein the diffuser surrounds all of the plurality of light sources.

20. The image forming apparatus as claimed in claim 12, wherein the electrostatic latent image forming medium further comprises a micro-lens array including a plurality of focusing lenses that focus light emitted from the light source to the respective optical shutters.

21. The image forming apparatus as claimed in claim 20, wherein the micro-lens array is integrally formed with the transparent frame member.

22. The image forming apparatus as claimed in claim 12, wherein the optical shutter array is flexible such that it can be wound around an outer surface of the transparent frame member.

23. The image forming apparatus as claimed in claim 12, further comprising a potential eliminating unit eliminating the potential on the surface of the electrostatic latent image forming medium.

* * * * *